US006163303A

United States Patent [19]

Nagy

[11] Patent Number: 6,163,303

[45] Date of Patent: Dec. 19, 2000

[54] AM UPPER/FM DEFOGGER GRID ACTIVE BACKLITE ANTENNA

[75] Inventor: Louis Leonard Nagy, Warren, Mich.

[73] Assignees: General Motors Corporation, Detroit; Delphi Technologies, Inc., Troy, both of Mich.

[21] Appl. No.: 09/354,860

[22] Filed: Jul. 29, 1999

[51] Int. Cl.[7] ..... H01Q 1/32

[52] U.S. Cl. ..... 343/713; 343/704; 343/860

[58] Field of Search ..... 343/704, 713, 343/858, 860, 711, 712, 850

[56] References Cited

U.S. PATENT DOCUMENTS

| | | | |
|---|---|---|---|
| 5,610,619 | 3/1997 | Zafar | 343/713 |
| 5,640,167 | 6/1997 | Hall | 343/704 |
| 5,739,794 | 4/1998 | Nagy et al. | 343/711 |
| 5,790,079 | 8/1998 | Zafar | 343/860 |
| 6,031,500 | 2/2000 | Nagy et al. | 343/713 |

OTHER PUBLICATIONS

U.S. Ser. No. 08/773,919, filed Dec. 30, 1996, "Vehicle Window Antena".

*Primary Examiner*—Don Wong
*Assistant Examiner*—Thuy Vinh Tran
*Attorney, Agent, or Firm*—George A. Grove

[57] ABSTRACT

A vehicle backlite antenna system that includes separate FM antenna/defogger elements and AM antenna elements. The antenna system includes various FM impedance matching elements that provide FM impedance matching between the defogger elements or the antenna elements and an RF amplifier. These impedance matching elements include a shorting bar connecting a plurality of the AM antenna elements that is positioned between end bars of an AM antenna grid. The shorting bar can be a certain distance from the AM feedpoint to provide impedance matching for the low end of the FM frequency band. Additionally, a floating impedance matching element is connected to the FM antenna/defogger elements between the defogger elements and the AM antenna grid. The floating element can have a certain length to provide impedance matching for the upper end of the FM band. Extended ground planes can also be provided it the upper corners of the window between the vehicle body and the AM antenna elements to control the gap between the AM antenna grid and the vehicle body to control the electrical coupling between the AM antenna grid and the vehicle body. Also, the FM antenna/defogger elements can include two vertical shorting elements between defogger grid bus bars.

19 Claims, 1 Drawing Sheet

AM UPPER/FM DEFOGGER GRID ACTIVE BACKLITE ANTENNA

TECHNICAL FIELD

This invention relates generally to a vehicle antenna and, more particularly, to a vehicle backlite antenna including separate AM antenna grid elements and FM antenna/defogger grid elements, and specialized FM impedance matching elements.

BACKGROUND OF THE INVENTION

Most modern vehicles include a vehicle radio that requires an antenna system to receive amplitude modulation (AM) and frequency modulation (FM) broadcasts from various radio stations. In the United States, the FM transmission band is in the frequency range of 88 MHz to 108 MHz, and the AM transmission band is in the frequency range of 530 kHz to 1710 kHz. Many present day vehicle antenna systems include a mast antenna that extends from a vehicle fender, vehicle roof, or some applicable location on the vehicle. Although mast antennas provide acceptable AM and FM reception, it has been recognized by vehicle manufacturers that the performance of a mast antenna cannot be significantly increased, and therefore, improvements obtained in other areas of in-vehicle entertainment systems will not include reception capabilities of the mast antenna. Consequently, vehicle manufacturers have sought other types of antenna designs to keep pace with consumer demands for increased vehicle stereo and radio capabilities.

Improvements in vehicle antenna systems have included the development of backlite antenna systems, where antenna elements are formed on a rear window of the vehicle. The antenna elements are typically made of a conductive frit material deposited and patterned on the inside surface of the window. Backlite antenna systems provide a number of other advantages over mast antenna systems, including no wind noise, reduce drag on the vehicle, elimination of corrosion of the antenna, no performance change with time, limited risk of vandalism, and reduced cost and installation.

Most vehicles include conductive defogger elements on the rear window of the vehicle, also formed of the conductive frit material, that are electrically energized to heat the window to eliminate condensation and ice. It has heretofore been known in the art to use the same defogger elements as the antenna elements to provide AM and FM reception. Unfortunately, the voltage applied to the defogger elements causes noise interference to the AM reception that significantly affects antenna performance. This noise interference can also affect FM reception. To reduce the noise interference in the antenna backlite designs, it is known to provide antenna elements in the back window of the vehicle that are separate from the defogger elements.

Some of these designs use the separated antenna elements for both AM and FM reception. In this type of design, the antenna elements and the defogger elements are not directly connected to each other, but are spaced from each other so that defogger elements are coupled to the antenna elements and are driven as a parasitic antenna element. Since the defogger elements cover most of the viewing area of the rear window, the antenna elements are confined to an upper portion of the window. The vehicle body acts as a ground plane and is coupled to the antenna elements through a urethane seal that seals the rear window to a vehicle body flange. It is important to control the smallest distance between the antenna elements and the body metal ground plane to control the antenna impedance.

Other antenna designs use the rear window defogger elements for FM reception but separate antenna elements for AM reception. For these backlite antenna systems, FM energy is still received by the AM antenna elements. These FM signals can be coupled into the conductive vehicle body from the AM antenna elements and then from the vehicle body into the FM antenna. Also, FM coupling occurs between the AM antenna elements and the defogger elements. This FM signal coupling creates an impedance mismatch between the FM antenna feed and the RF amplifier that affects FM antenna performance. Therefore, it is desirable to provide additional impedance matching elements in connection with the defogger elements and the antenna elements in this type of backlite antenna system. It is an object of the present invention to provide such impedance matching elements.

SUMMARY OF THE INVENTION

In accordance with the teachings of the present invention, a vehicle backlite antenna system is disclosed that includes separate FM antenna/defogger elements and AM antenna elements on the vehicle back window. The antenna system includes various FM impedance matching elements that provide FM impedance matching between the defogger elements or the antenna elements and an RF amplifier. These impedance matching elements include a shorting bar connecting the AM antenna elements that is positioned between connecting end bars of an AM antenna grid. The shorting bar can be a certain distance from the AM feedpoint to provide impedance matching for the low end of the FM frequency band. Additionally, a floating impedance matching element is connected to the FM antenna/defogger elements between the defogger elements and the MA antenna grid. This floating element can have a certain length to provide impedance matching for the upper end of the FM band. Extended ground planes can also be provided at the upper corners of the window between the vehicle body and the AM antenna elements to control the gap between the AM antenna grid and the vehicle body, and thus control the current coupling between the AM antenna grid and the vehicle body.

Additional objects, advantages and features of the present invention will become apparent from the following description and appended claims, taken in conjunction with the accompanying drawings.

DESCRIPTION OF THE PREFERRED EMBODIMENT

The following discussion of the preferred embodiments directed to a backlite antenna system for a vehicle is merely exemplary in nature and is in no way intended to limit the invention or its applications or uses.

Figure 1:
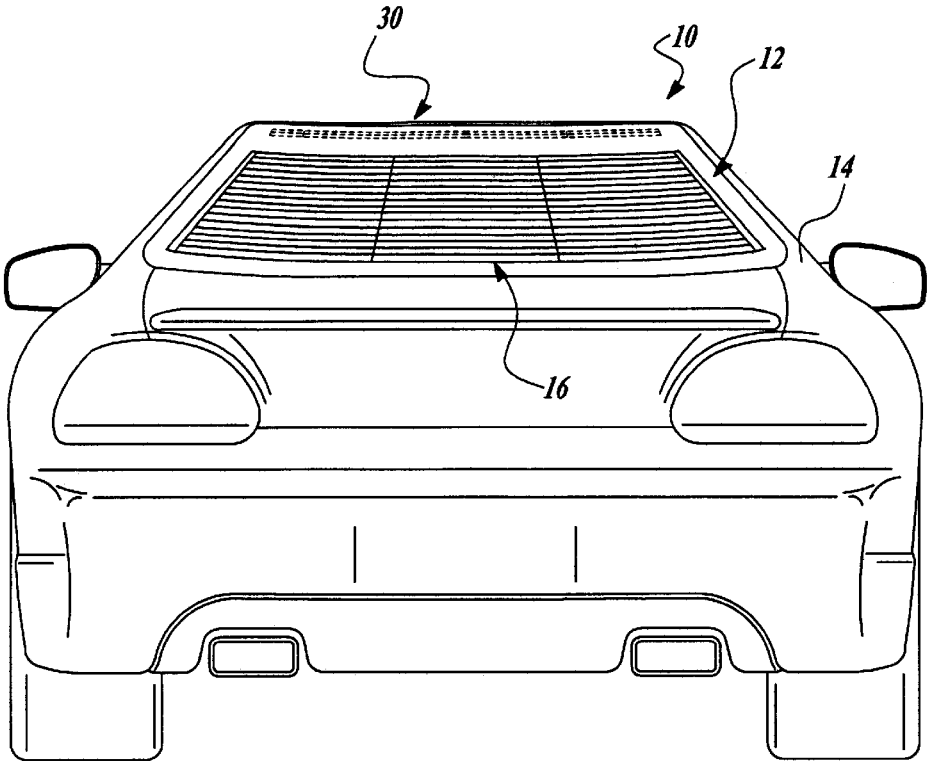
FIG. 1 is a back view of a vehicle incorporating a backlite antenna system, according to an embodiment of the present.

FIG. 1 is a back view of a vehicle 10 including a rear window 12 or backlite. The window 12 is positioned within an opening formed in a conductive vehicle body 14. The window 12 is placed on a window flange (not shown) that extends into the opening from the vehicle body 14 and is sealed therein by a suitable seal material, such as urethane.

The process and technique for mounting a rear window in a vehicle is well understood to those skilled in the art.

Figure 2:
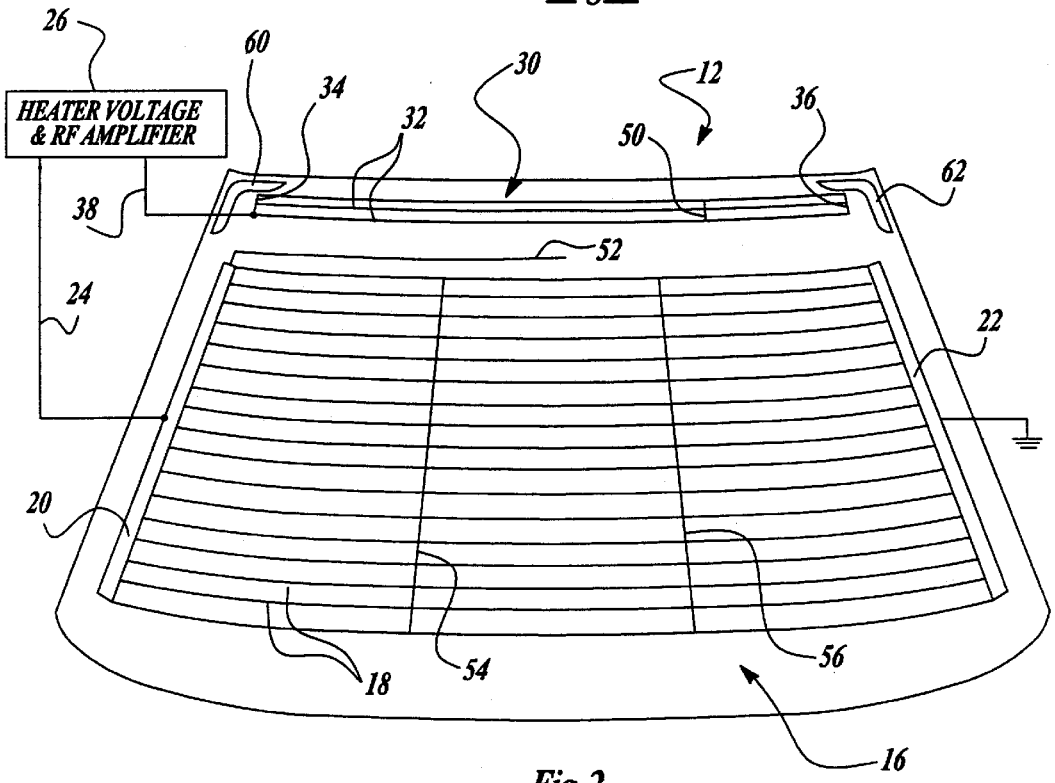
FIG. 2 is a diagrammatic view of the antenna elements and defogger elements formed on the rear window of the vehicle shown in FIG. 1.

FIG. 2 shows a diagrammatic plan view of the rear window 12 removed from the vehicle 10. A defogger grid 16 is formed on a bottom portion of the rear window 12 and extends across the width of the window 12, as shown. In this embodiment, the defogger grid 16 is also used as an FM antenna. The defogger grid 16 includes a plurality of parallel, spaced-apart defogger elements 18 extending across the window 12. The defogger elements 18 are connected at each end by two opposing widened, vertical defogger end bus bars 20 and 22. In one embodiment, the elements 18 and the bus bars 20 and 22 are made of a conductive frit material, formed and patterned on an inside surface of the window 12. The defogger grid 16 takes up most of the area of the window 12 to be effective and is electromagnetically coupled to the vehicle body 14.

An electrical current is applied to the grid 16 through the bus bar 20 to heat the elements 18 and thus the window 12. The bus bar 22 is grounded to the vehicle body 14. One end of an FM antenna feed line 24 is connected to the bus bar 20, and the opposite end of the feed line 24 is connected to a heater voltage and RF amplifier 26. The amplifier 26 provides the current to heat the elements 18 and includes an impedance matching network to provide impedance matching between the grid 16 and the amplifier 26.

As discussed above, it is beneficial for noise reduction purposes to remove the AM antenna elements from the defogger grid 16. In this regard, an AM antenna grid 30 is provided in an upper portion of the window 12 separate from the grid 16 and includes a plurality of antenna elements 32 extending across the window 12. The antenna elements 32 are electrically connected together at both ends by antenna element bus bars 34 and 36 to provide a closed circuit. In this embodiment, three antenna elements 32 are shown; however, in alternate designs, two or more antenna elements can be provided. One end of an AM antenna feed line 38 is connected to the bus bar 34 at a feedpoint location, and the other end of the feed line 38 is connected to the amplifier 26. The bus bar 36 is grounded to the vehicle body 14. The antenna grid 30 is electromagnetically coupled to the vehicle body 14 through the urethane seal. Additionally, the antenna grid 30 is electromagnetically coupled to the defogger grid 16 and creates a parasitic antenna element.

According to the invention, FM impedance matching elements are provided to provide FM impedance matching between the defogger grid 16 and the amplifier 26, and the antenna grid 30 and the amplifier 26 for better FM reception. In this regard, a vertical shorting bar 50 is included in the grid 30 that electrically connects the antenna elements 32 between the end bars 34 and 36, as shown. The shorting bar 50 provides impedance matching for FM signals that are received by the antenna grid 30. In one embodiment, the shorting bar 50 is about two inches long and is positioned a distance from the AM feedpoint on the bus bar 34 slightly greater than one-quarter of the wavelength of the lowest frequency of the FM band (88 MHz) to impedance match the lower end of the FM frequency band. In one embodiment, the shorting bar 50 is about thirty-four inches from the bus bar 34. The shorting bar 50 thus provides an approximate 34 inch×2 inch matching element. This is by way of a non-limiting example, in that the distance the shorting bar 50 is from the feedpoint for the AM signal can be changed from design to design depending on the FM frequencies which would benefit from the best impedance matching. For example, the distance the shorting bar 50 is from the feedpoint for the AM signal can be around one-quarter of the wavelength of the center frequency of the FM band.

To provide the impedance matching for the upper end of the FM band, a floating impedance matching element 52 is connected to the end bar 20 and extends between the antenna grid 30 and the defogger grid 14 in an open circuit configuration, as shown. In one embodiment, the length of the grid element 52 is about twenty-one inches, or slightly less than one-quarter of the wavelength of the highest frequency of the FM frequency band (108 MHz). Therefore, the floating element 52 provides FM impedance matching for the upper end of the FM band. Of course, the length of the floating element 52 may vary from design to design to provide better impedance matching for different parts of the FM frequency band. The length of the floating element 52 can also be around one-quarter of the wavelength of the center of the FM frequency band.

Additionally, two vertical shorting elements 54 and 56 are connected to the elements 18 of the defogger grid 14 between the bus bars 20 and 22. The vertical shorting elements 54 and 56 electrically connect the center portion of the elements 18 to make the elements 18 have a consistent plane across their length. Additionally, the shorting elements 54 and 56 counter the effects of the parasitic resonance present in the FM antenna characteristic impedance and minimize the effects of cross-polarization, thereby resulting in an omni-directional polar response of FM frequencies. In one embodiment, the vertical shorting element 54 is positioned approximately one-eighth of the wavelength of the center frequency of the FM band from the bus bar 20, and the shorting element 56 is positioned approximately one-eighth of the wavelength of the center frequency of the FM band from the bus bar 22. Also, the shorting elements 54 and 56 are spaced a distance less than one-eighth of the wavelength of the center of the FM frequency band from each other.

To control the capacitive coupling between the antenna grid 30 and the vehicle body 14, L-shaped corner FM ground planes 60 and 62 are provided in the upper corners of the window 12 between the antenna grid 30 and the vehicle body 14. As discussed in U.S. Ser. No. 08/773,919, filed Dec. 30, 1996, entitled "Vehicle Window Antenna," these corner elements provide coupling to the RF vehicle body currents. The ground planes 60 and 62 are widened frit elements that control the gap between the antenna grid 30 and the vehicle body 14 to control the RF currents between the vehicle body 16 and the grid 30. Particularly, the ground planes 60 and 62 provide a minimum known distance of the conductive coupling between the vehicle body 14 and the antenna grid 30 to provide a known impedance. A more detailed discussion of the operation of the ground planes 60 and 62 can be found in the '919 application.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system for a vehicle, said antenna system comprising:

a defogger grid formed on a vehicle window, said defogger grid including a plurality of defogger elements that are connected at opposite ends by a first defogger bus bar and a second defogger bus bar;

an antenna grid formed on the vehicle window separate from the defogger grid, said antenna grid including a plurality of antenna elements that are connected at opposite ends by a first antenna bus bar and a second antenna bus bar, said antenna grid including a shorting grid element connecting the plurality of antenna elements between the antenna bus bar and providing FM impedance matching, said shorting grid element being connected to the plurality of antenna elements a distance from the first antenna bus bar that is one-quarter of the wavelength of a frequency in the FM frequency band; and an AM antenna feed line connected to the first antenna bus bar and an FM antenna feed line connected to the first defogger bus bar so that the antenna grid provides AM reception and the defogger grid provides FM reception.

2. The antenna system according to claim 1 wherein the shorting grid element is about 34 inches from the first antenna bus bar, and provides impedance matching for the low end of the FM frequency band two inches in length.

3. The antenna system according to claim 1 wherein the defogger grid further includes a floating FM impedance matching element having a first end connected to the first defogger bus bar and a second end that is floating to provide an open circuit, said floating element also providing FM impedance matching and having a length that is one-quarter of a wavelength of a frequency in the FM frequency band.

4. The antenna system according to claim 3 wherein the floating element is about 21 inches long and provides impedance matching for the high end of the FM frequency band.

5. The antenna system according to claim 1 further comprising a first conductive ground plane positioned proximate a first upper corner of the window between the antenna grid and a vehicle body and a second conductive ground plane positioned in a second upper corner of the window between the antenna grid and the vehicle body, said first and second conductive ground planes controlling the electrical coupling between the antenna grid and the vehicle body.

6. The antenna system according to claim 1 wherein the defogger grid includes first and second vertical defogger grid elements connecting the plurality of defogger grid elements between the first and second defogger bus bars, said first and second vertical defogger grid elements providing FM impedance matching.

7. The antenna system according to claim 6 wherein the first vertical grid element is positioned about one-eighth of the wavelength of the center frequency of the FM band from the first defogger bus bar and the second vertical grid element is positioned approximately one-eighth of the wavelength of the center frequency of the FM band from the second defogger bus bar.

8. The antenna system according to claim 6 wherein the first and second grid elements are spaced a distance apart less than one-eighth of the wavelength of the center of the FM frequency band.

9. The antenna system according to claim 1 wherein the vehicle window is a rear window of the vehicle and the antenna system is a vehicle backlite antenna system.

10. A vehicle backlite antenna system for providing AM and FM reception, said antenna system comprising:

a defogger grid formed on a lower portion of a rear window of the vehicle, said defogger grid including a plurality of defogger elements that are connected at opposite ends by a first defogger bus bar and a second defogger bus bar, said defogger grid further including a floating impedance matching element having a first end connected to the first defogger bus bar and a second end that is floating in an open circuit configuration, said floating impedance element having a length that is one-quarter of the wavelength of a frequency in the FM frequency band, said defogger grid further including first and second vertical defogger grid elements connecting the plurality of defogger grid elements between the first and second defogger bus bars, said floating element and said first and second defogger grid elements providing FM impedance matching; and an antenna grid formed on the rear vehicle window separate from the defogger grid, said antenna grid including a plurality of antenna elements that are connected at opposite ends by a first antenna bus bar and a second antenna bus bar, said antenna grid including a shorting grid element connecting the plurality of antenna elements between the antenna bus bars, said shorting grid element being connected to the plurality of antenna elements a distance from the first antenna bus bar that is one-quarter of the wavelength of a frequency in the FM frequency band, said shorting bar also providing FM impedance matching.

11. The antenna system according to claim 10 wherein the shorting grid element is about 34 inches from the first antenna bus bar and provides impedance matching for the low end of the FM frequency band.

12. The antenna system according to claim 10 wherein the floating element is about 21 inches long and provides impedance matching for the high end of the FM frequency band.

13. The antenna system according to claim 10 wherein the first vertical grid element is positioned about one-eighth of the wavelength of the center frequency of the FM band from the first defogger bus bar and the second vertical grid element is positioned approximately one-eighth of the wavelength of the center frequency of the FM band from the second defogger bus bar.

14. The antenna system according to claim 10 wherein the first and second grid elements are spaced a distance apart less than one-eighth of the wavelength of the center of the FM frequency band.

15. The antenna system according to claim 10 further comprising a first conductive ground plane positioned proximate a first upper corner of the window between the antenna grid and a vehicle body and a second conductive ground plane positioned in a second upper corner of the window between the antenna grid and the vehicle body, said first and second conductive ground planes controlling the electrical coupling between the antenna grid and vehicle body.

16. A method of providing AM and FM reception for a vehicle, said method comprising the steps of:

forming a defogger grid on a vehicle window that includes a plurality of defogger elements connected at opposite ends by a first defogger bus bar and a second defogger bus bar;

providing an antenna grid on the vehicle window separate from the defogger grid to include a plurality of antenna elements that are connected at opposite ends by a first antenna bus bar and a second antenna bus bar, said step of providing an antenna grid including providing a shorting grid element connecting the plurality of antenna elements between the antenna bus bars a distance from the first antenna bus bar that is one-quarter of the wavelength of the frequency in the FM frequency band;

connecting an AM antenna feed line to tile first antenna bus bar and an FM feed line to the first defogger bus bar to provide the AM and FM reception; and using the shorting grid element to provide impedance matching for the FM reception.

17. The method according to claim 16 further comprising the steps of providing a floating impedance matching element having a first end connected to the first defogger bus bar and a second end that is floating where the length of the floating element is one-quarter of the wavelength of a frequency in the FM frequency band, and using the floating impedance matching element to provide FM impedance matching.

18. The method according to claim 16 further comprising the steps of providing a first conductive ground plane positioned proximate a first upper corner of the window between the antenna grid and the vehicle body and providing a second conductive ground plane positioned in the second upper corner of the window between the antenna grid and the vehicle body and using the first and second ground planes to control the electrical coupling between the antenna grid and the vehicle body.

19. The method according to claim 16 wherein the step of providing a defogger grid includes providing first and second vertical defogger grid elements connecting the plurality of defogger grid elements between the first and second defogger bus bars, and using the first and second vertical defogger grid elements to provide FM impedance matching.

* * * * *